US005222900A

United States Patent [19]

Tsujii

[11] Patent Number: 5,222,900

[45] Date of Patent: Jun. 29, 1993

[54] TILT CYLINDER ARRANGEMENT FOR OUTBOARD DRIVE

[75] Inventor: Eiichiro Tsujii, Hamamatsu, Japan

[73] Assignee: Sanshin Kogyo Kabushik Kaisha, Hamamatsu, Japan

[21] Appl. No.: 800,605

[22] Filed: Nov. 27, 1991

[30] Foreign Application Priority Data

Nov. 29, 1990 [JP] Japan ..... 2-325857

[51] Int. Cl.[5] ..... B63H 5/12

[52] U.S. Cl. ..... 440/56

[58] Field of Search ..... 440/55, 56, 61; 188/314; 267/64.25

[56] References Cited

U.S. PATENT DOCUMENTS

| | | | |
|---|---|---|---|
| 2,953,335 | 9/1960 | Kiekhaefer | 440/61 |
| 4,153,237 | 5/1979 | Supalla | 188/314 X |
| 4,551,104 | 11/1985 | Iwashita et al. | 440/56 |
| 4,784,625 | 11/1988 | Nakahama | 440/56 |
| 5,074,193 | 12/1991 | Hundertmark | 440/61 |
| 5,094,325 | 3/1992 | Smith | 188/314 X |

FOREIGN PATENT DOCUMENTS

| | | | |
|---|---|---|---|
| 0100094 | 6/1984 | Japan | 440/61 |
| 0290795 | 11/1990 | Japan | 440/56 |
| 1243964 | 7/1986 | U.S.S.R. | 188/314 |

*Primary Examiner*—Sherman Basinger
*Attorney, Agent, or Firm*—Ernest A. Beutler

[57] ABSTRACT

A number of embodiments of hydraulic assemblies for interpositioning between a marine outboard drive and a watercraft for controlling the position of the outboard drive relative to the watercraft. Each embodiment includes a double acting cylinder assembly but the chambers of the cylinder assemblies do not communicate with each other so that they may be filled with different fluids and/or a fluid and a gas and at different pressures to provide manual tilt up assistance. Various control valve arrangements are also disclosed for permitting popping up action and for permitting manual tilt up operation.

13 Claims, 4 Drawing Sheets

TILT CYLINDER ARRANGEMENT FOR OUTBOARD DRIVE

BACKGROUND OF THE INVENTION

This invention relates to a tilt cylinder arrangement for an outboard drive and more particularly to an improved hydraulic tilt control mechanism.

It is well known in marine outboard drives to provide a hydraulic cylinder assembly interposed between the outboard drive portion and the transom of the watercraft for controlling the position of the outboard drive. These mechanisms may also provide a shock absorbing function so as to permit the outboard drive to pop up when an underwater obstacle is struck and then return to its normal position once the underwater obstacle is cleared. A wide variety of hydraulic arrangements have been proposed for this purpose.

Substantially all of these hydraulic arrangements include a double acting hydraulic cylinder assembly wherein flow passes from one side of a piston to the other upon movement and then may return upon return movement. With such arrangements, however, a piston rod is connected to the piston and extends through one of the chambers. Hence, when fluid is interchanged between the chambers, there will be an unequal amount of fluid displacement due to the fact that the piston rod displaces some of the fluid area in the chamber through which it extends. Therefore, it has been practiced to provide some form of makeup chamber which communicates with the device so as to accommodate these changes in fluid displacement caused by the piston rod. Of course, such a makeup device must provide a volume above the fluid so as to accommodate the variations in amount of fluid contained within the makeup chamber. This type of construction gives rise to a number of problems.

Specifically, if the makeup chamber is an open chamber and the gas or air above the fluid is not sealed from the fluid, there is a risk that the gas may enter the hydraulic system and interfere with its effective operation. That is, the air or gas may become entrained in the hydraulic fluid and adversely effect the operation of the fluid device.

Although these problems can be avoided by providing an impermeable barrier between the fluid and the gas or air over the fluid, such an arrangement can add to the cost of the system.

It is, therefore, a principal object of this invention to provide an improved hydraulic cylinder assembly for a marine outboard drive which does not require flow between two chambers of the hydraulic cylinder for its operation.

In systems embodying hydraulic cylinders of the type previously described, it has also been proposed to provide a bypass passageway between the two chambers in which a control valve is positioned. The control valve is opened so as to permit tilting up of the outboard drive without having to overcome the fluid resistance. In addition, it has been proposed to pressurize the gas over the fluid in the system so that the pressure of the gas will assist in raising the outboard drive when the valve is opened. However, the amount of lift provided by the gas pressure is relatively small since the pressure acts only over the differential area established by the piston rod. That is, it is not possible to provide separate pressurization which can act to assist in lifting the outboard motor since both chambers normally communicate with each other.

It is, therefore, a further object of this invention to provide an improved hydraulic arrangement for an outboard drive wherein the system can be pressurized to provide adequate lift without having it upset the normal operation of the outboard drive.

It is a further object of this invention to provide an improved hydraulic control for a marine outboard drive.

In addition to the difficulties as aforenoted, the types of hydraulic devices previously described also have the problem in that each chamber of the fluid cylinder must be filled with the same fluid due to the interchange of fluid between the chambers. Because of this, it is not possible to employ different fluids so as to provide different types of effects.

It is, therefore, a still further object of this invention to provide an improved hydraulic assembly for a marine outboard drive that can be double acting and which still may employ different fluids in each chamber.

SUMMARY OF THE INVENTION

This invention is adapted to be embodied in a hydraulic assembly adapted to be positioned between a marine outboard drive and a watercraft for fluid damping of the movement of the outboard drive relative to the watercraft. The hydraulic assembly includes cylinder means adapted to be connected to one of the outboard drive in the watercraft and piston means that are moveable within the cylinder means in which divides the cylinder means into a pair of opposite chambers. A piston rod is affixed at one end to the piston means and extends through one of the chambers and is adapted to be affixed at its other end to the other of the outboard drive and the watercraft. An accumulator chamber communicates with only one of the cylinder assembly chambers for flow between the one cylinder assembly chamber and the accumulator chamber in responses to variations in the volume of the one cylinder assembly chamber as the piston means moves relative to the cylinder means.

DETAILED DESCRIPTION OF THE PREFERRED EMBODIMENTS OF THE INVENTION

Figure 1:
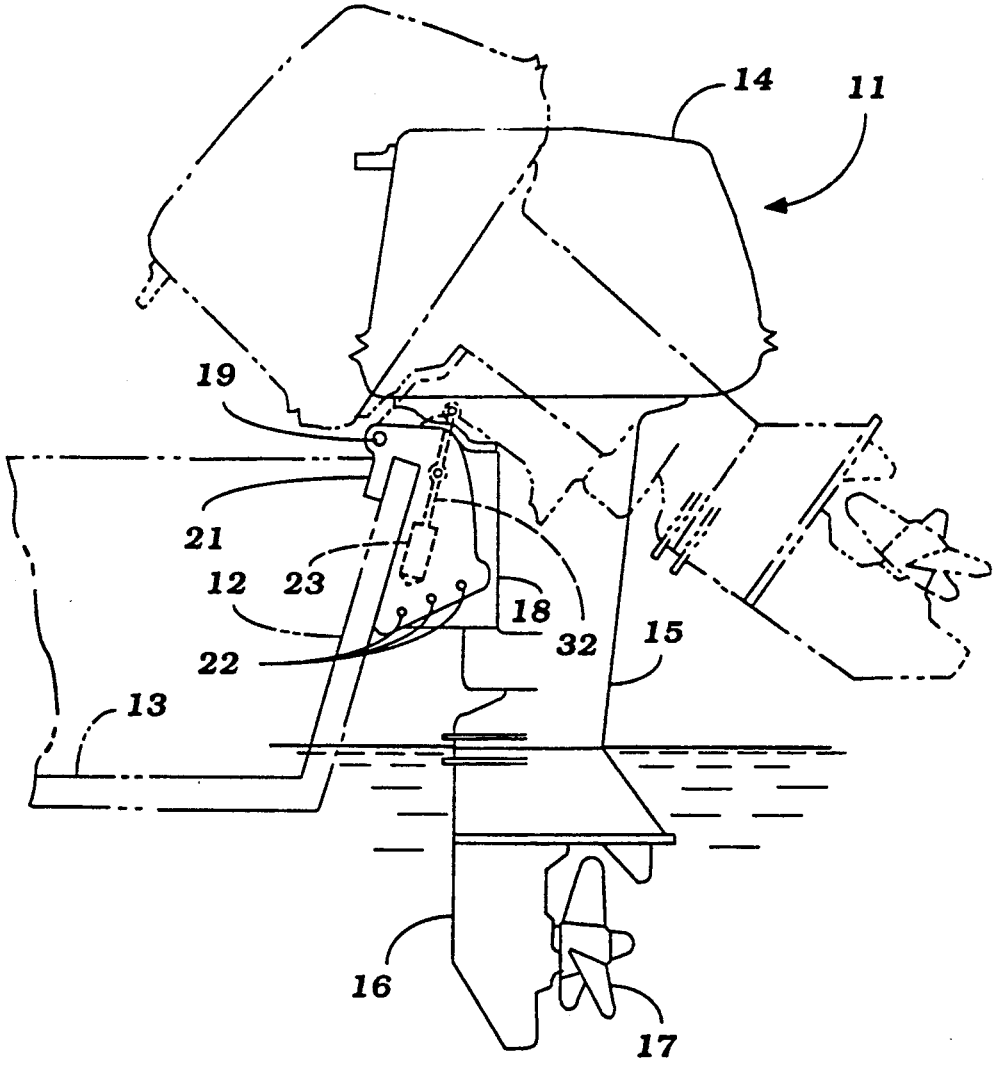
FIG. 1 is a side elevational view of an outboard motor attached to the transom of watercraft, showing partially and in phantom, and shows the outboard drive in its normal running condition and in solid lines and in a tilted up out of the water condition in phantom.

Referring now in detail to the drawings and initially to FIG. 1, an outboard motor having a hydraulic assembly constructed in accordance with an embodiment of the invention is identified generally by the reference numeral 11 and is depicted as being attached to the transom 12 of a watercraft 13, shown partially and in phantom. The invention is described in conjunction with an outboard motor but may also be employed in conjunction with the outboard drive portion of an inboard/outboard drive, as is well known in this art. Such devices are termed generically herein and in the claims as "outboard drives".

The outboard motor 11 includes a power head 14 which includes a powering internal combustion engine and a surrounding protective cowling. The engine drives a driveshaft (not shown) that extends through a driveshaft housing 15 and which is journaled for rotation about a vertically extending axis. This driveshaft terminates within a lower unit 16 wherein there is provided a forward, neutral, reverse transmission of any known type for driving a propeller 17.

The driveshaft housing 15 has affixed to it a steering shaft (not shown) which is journaled for steering movement in a swivel bracket 18. The swivel bracket 18 is, in turn, connected by means of a pivot pin 19 to a clamping bracket 21. This pivotal connection permits the outboard motor 11 to be pivoted between a plurality of trim adjusted positions from its normal position, as shown in solid lines in FIG. 1, to a tilted up out of the water position as shown in phantom lines.

The trim adjusted position is set, in accordance with certain embodiments of the invention, by means of a trim pin which is disposed in one of selected pairs of apertures 22 formed in the clamping bracket 21. A hydraulic cylinder assembly, indicated generally by the reference numeral 23 in interposed between the clamping bracket 21 and the swivel bracket 18 for preventing popping up of the outboard motor 11 when operating in reverse but also for permitting the outboard motor 11 to pop up once an underwater obstacle is struck and then returned to its normal trim position once the underwater obstacle is cleared. The invention relates to the specific construction of the hydraulic device 23 and various embodiments are shown in the remaining figures and will be described by reference to them.

Figure 2:
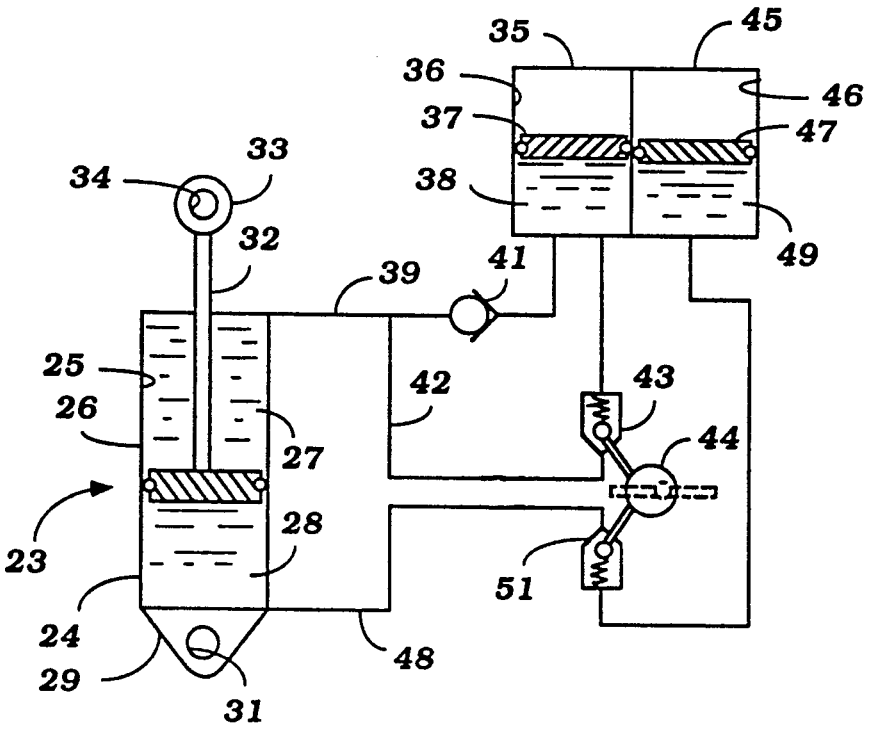
FIG. 2 is a partially schematic cross sectional view taken through a cylinder assembly adapted to be associated with an outboard drive as shown in FIG. 1.

One embodiment of cylinder assembly and associated controls therefore is depicted in FIG. 2. It may be seen that the assembly 23 includes a cylinder housing 24 having a bore 25 in which a piston 26 is received so as to divide the internal portion of the cylinder assembly 24 into an upper chamber 27 and a lower chamber 28.

The cylinder assembly 24 is provided with a trunnion portion 29 that is apertured as at 31 so as to receive a pivot pin to provide the pivotal connection to the clamping bracket 21.

A piston rod 32 extends through the upper chamber 27 and is fixed, at one end, to the piston 26. The exposed end of the piston rod 32 is formed with an eyelet 33 having an opening 34 to receive a pivot pin to provide a pivotal connection to the swivel bracket 18.

The upper chamber 27 is provided with an accumulator reservoir 35 that defines an internal volume 36 in which a piston 37 is supported and beneath which fluid 38 is received from or transmitted to the chamber 27. A conduit 39 in which a check valve 41 is provided between the upper chamber 27 and the accumulator chamber 35 with the check valve 41 permitting flow from the accumulator 35 to the chamber 27 but not in the reverse direction.

There is provided also a passageway 42 that intersects the passageway 39 upstream of the check valve 41 and in which a check valve 43 is positioned. The check valve 43 operates to permit flow from the chamber 27 to the accumulator 35 but not in the reverse direction. A valving device, indicated generally by the reference numeral 44 is provided for manually unseating the check valve 43, for a reason to be described.

A second accumulator chamber 45 is provided for the lower cylinder chamber 28 and also has an internal volume 46 in which a floating piston 47 is positioned. A conduit 48 interconnects the chamber 28 with the accumulator 45 so that its hydraulic fluid may flow into an area 49 below the floating piston 47. A check valve 51 is provided in the conduit 48 and permits flow from the chamber 28 to the accumulator 49 but which precludes flow in the reverse direction. The manual operator 44 is also adapted to open the check valve 51 at the same time the check valve 43 is opened, for a purpose now to be described.

When the manual device 44 is in the position shown in FIG. 2, both check valves 43 and 51 will be unseated and the outboard motor 11 may be tilted up or down without resistance from the fluid system. When tilted up, fluid flows from the chamber 27 through the conduits 39 and 42 and open check valve 43 to the accumulator 35. At the same time, fluid can flow from the accumulator 45 to the lower chamber 28 through the conduit 48 and open check valve 51. In order to assist the tilting up operation, the accumulator chamber 45 has its volume 46 charged with the gas received therein at a pressure that is substantially greater than atmospheric. The pressure in the accumulator chamber 35 and the void 36 above the liquid level 38 is, on the other hand, substantially at atmospheric pressure. As a result of this and because the chambers 27 and 28 of the hydraulic assembly 23 are isolated from each other, such unequal pressures are possible and hence a greater lift up force may be applied by the pressure in the accumulator chamber 45. This greater pressure, however, does not adversely effect the normal pop-up operation which will be described. Because the accumulator 45 is charged with a higher pressure, a greater tilt-up force assist may be employed than with prior art devices because this higher pressure operates over the full area of the piston 26 and not only upon the area of the piston rod 32 in prior art constructions when both chambers 27 and 28 communicate with each other and must be charged to the same pressure.

During tilting down operation, fluid is displaced from the chamber 28 back to the accumulator 45 through the conduit 48 and open check valve 51 and fluid returns to the upper chamber 57 from the accumulator 35 through the open check valve 43 and conduits 42 and 39.

When the manual operator 44 is in a position so that the check valves 43 and 51 are not held manually open, the hydraulic device 23 serves to retain the outboard motor 11 in a trim adjusted position. If the outboard motor is not fully trimmed down, it may be trimmed down by applying a large driving thrust to the unit by operating the propeller 17 at a high speed in a forward direction. If the trim pin, previously referred to, is not engaged by the swivel bracket 18 a force will be placed on the piston 26 to cause it to move downwardly and pressurize the fluid in the chamber 28. The check valve 51 will open if sufficient force is exerted and fluid will be displaced back into the accumulator 45.

During this downward movement, makeup fluid can be delivered to the chamber 27 from the accumulator 35 through the check valve 41 which opens at a relatively light pressure. It should be noted that due to the displacement of the piston rod 28 in the chamber 27 more fluid will be displaced from the chamber 28 than is required for makeup in the chamber 27.

If an underwater obstacle is struck when the manual valve 44 is closed, the piston 28 will tend to move upwardly and compress the fluid in the chamber 27. If sufficient force is encountered, the check valve 43 will open and permit fluid to flow into the accumulator 35 so as to provide a hydraulic damping. When this occurs, there will tend to be a vacuum drawn in the chamber 28 but this will be precluded by vaporization of some of the fluid therein so that the chamber 28 will be filled by the fluid in either a liquid or gaseous state.

Once the underwater obstacle cleared, the weight of the outboard motor will cause the piston 26 to be forced downwardly and fluid will return to the chamber 27 from the accumulator 35 thought the check valve 41 which, as has been noted, opens at a relatively low pressure. The pressurization of the fluid in the chamber 28 will then cause this material all to return to the liquid state.

It should be noted that the fluid from the chamber 27 never flows to the chamber 28 and vice versa. Because of this, it is possible to use different fluids in each of these chambers so as to provide different damping effects as desired and also to have the accumulator associated with each chamber at a different pressure to assist in manual tilt-up, as noted.

Figure 3:
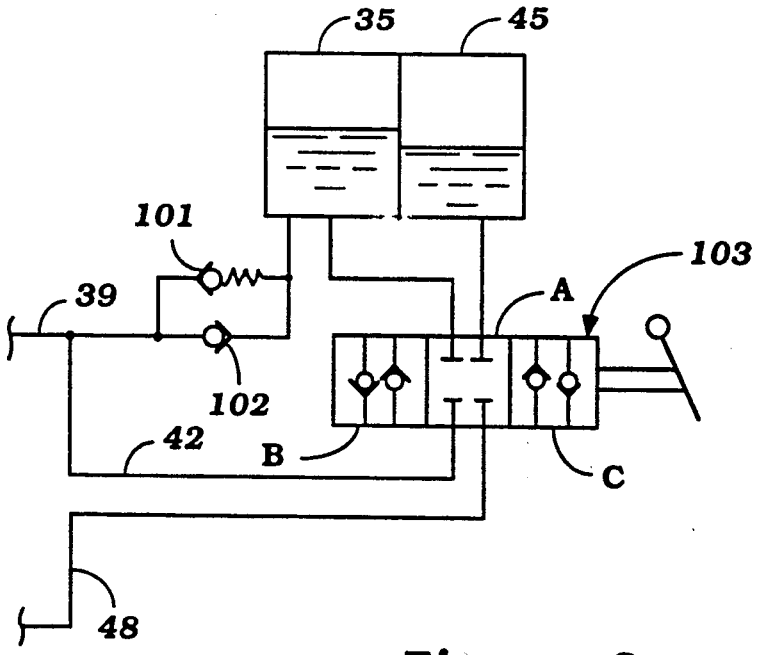
FIG. 3 is a partially schematic cross sectional view, in part similar to FIG. 2, and shows a different type of valving and accumulator arrangement therefor.

FIG. 3 shows another embodiment of this invention which is adapted to be employed with a cylinder of the type shown in FIG. 2 and identified in that figure by the reference numeral 23. Because of this similarity, the cylinder 23 is not shown in FIG. 3. As has been previously noted, the previously described embodiment permitted trimmed down adjustment if desired. However, trim up adjustment could not be achieved under power operation because the check valve 43 must be sufficiently strong so as to prevent the outboard motor from popping up when driving in reverse. The embodiment in FIG. 3 uses a different valving arrangement and accomplishes all of the functions of the previously described embodiment but also permits trim up adjustment under power.

In this embodiment it should also be noted that the reservoirs or accumulators 35 and 45 do not have floating pistons as in the previously described embodiment. It is not necessary, even in that embodiment, to employ the floating pistons because there is no likelihood that the air or other gas contained therein above the fluid level can enter the system.

In this embodiment, the one way lightly operating check valve 41 of the previously described embodiment is replaced by a spring biased check valve 101 and a lightly biased check valve 102 which operate in opposite directions. The check valve 101 acts as a shock absorber valve and permits fluid to flow from the chamber 27 to the accumulator 35 when an underwater obstacle is struck and thus functions like the check valve 43 of the previously described embodiment. The check valve 102 functions like the return check valve 41 of the previously described embodiment and permits fluid to return to the chamber 27 when the underwater obstacle is cleared.

The conduit 42 and conduit 48 have disposed within them a manually operated three position valve 103 which has a neutral or normally operating position A in which position the valve is shown wherein the conduits 42 and 48 are closed and wherein the device operates to provide shock absorbing.

If it is desired to provide tilt or trim up adjustment manually, the valve 103 is moved to a position B wherein a pair of check valves move into registry with the conduits 42 and 48 with one check valve permitting flow from the chamber 27 to the accumulator 35 and the other check valve permitting flow from the accumulator 45 to the conduit 48 and chamber 28. As a result of this communication, the outboard motor 11 may be either manually tilted up to its out of the water position or may be trimmed up by operating the propeller 17 in reverse. As with the previously described embodiment, the accumulator chamber 35 may be at atmospheric pressure while the pressure of the gas in the accumulator chamber 45 over the fluid can be at a higher pressure to assist in the tilt up operation. Again, the use of these different pressures is possible since the chambers 27 and 28 of the hydraulic cylinder assembly 2 do not communicate with each other.

The valve 103 has a further position C wherein a pair of check valves communicate with the conduits 42 and 48 so as to permit flow from the accumulator'35 to the cylinder chamber 27 and from the cylinder chamber 28 to the accumulator 45. This position permits tilt down and/or trim down adjustment by shifting the propeller 17 into forward drive position and accelerating the engine.

Figure 4:
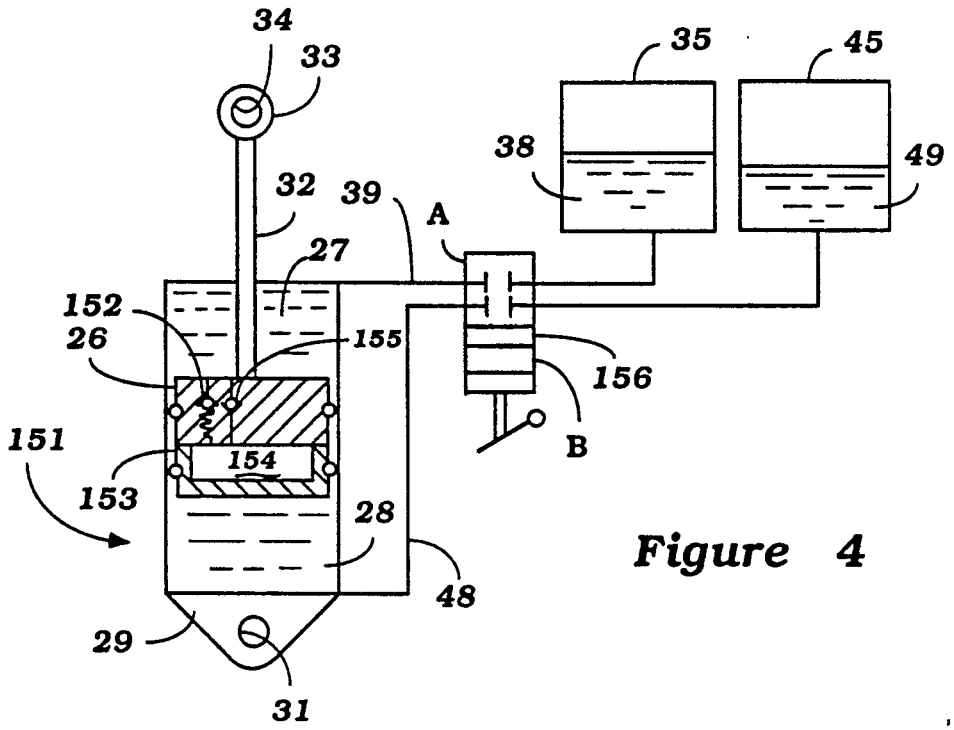
FIG. 4 is a partially schematic cross sectional view, in part similar to FIGS. 2 and 3, and shows yet another embodiment of the invention.

In the embodiments of the invention as thus far described the shock absorbing function has been accomplished by providing an absorber and return valve which are disposed externally from the cylinder 23. However, it is possible to provide such action by incorporating these valves into the piston 26 and such an embodiment is shown in FIG. 4 wherein the cylinder assembly is identified generally by the reference numeral 151. Many of the components of this embodiment are the same as the previously described embodiments and where that is the case the same reference numerals have been employed to designate these similar components.

In this embodiment, it will be seen that the piston 26 is provided with an absorber valve 152 that is spring biased to a closed position and will permit flow, when open, from the chamber 27 to the area below the piston 26. A floating piston 153 is provided between the chamber 28 and the area below the piston 26 so as to define a third chamber 154. This construction permits separate fluids to be employed in the chambers 27 and 28 for the aforenoted reasons. A lightly biased return valve 155 is provided in the piston 26 to permit flow from the chamber 154 back to the chamber 27.

In this embodiment, a manual release valve 156 is provided which has two positions. The first of these is an off position A as shown in FIG. 4 wherein the conduits 39 and 48 are blocked so that the chambers 27 and 28 cannot communicate with their respective accumulators 35 and 45. The other position B permits these chambers to communicate with each other so as to facilitate manual tilt up or tilt down of the outboard motor. Like the previously described embodiments, the pressure in the accumulator 35 may be atmospheric while the pressure in the accumulator 45 can be greater than atmospheric while the pressure in the accumulator 45 can be greater than atmospheric and greater than the pressure in the accumulator 35 to assist in tilt up operation.

When the manual valve 156 is in the position A, and an underwater obstacle is struck the piston 26 may move upwardly compressing the fluid in the chamber 27. If sufficient pressure is reached, the absorber valve 152 will open and fluid will flow into the chamber 154 so as to permit the outboard motor 11 to pop up. During this action, there will be slight movement of the piston 153 to accommodate for the varying volume of the piston rod 32 in the chamber 27, as afore described. Once the underwater obstacle is cleared, the weight of the outboard motor will force the piston 26 downwardly and the relief valve 155 will open and permit the fluid to flow from the chamber 154 back to the chamber 27 and the outboard motor will again return to its previously adjusted trim position which is set by the position of the floating piston 153, as is well known in this art.

Figure 5:
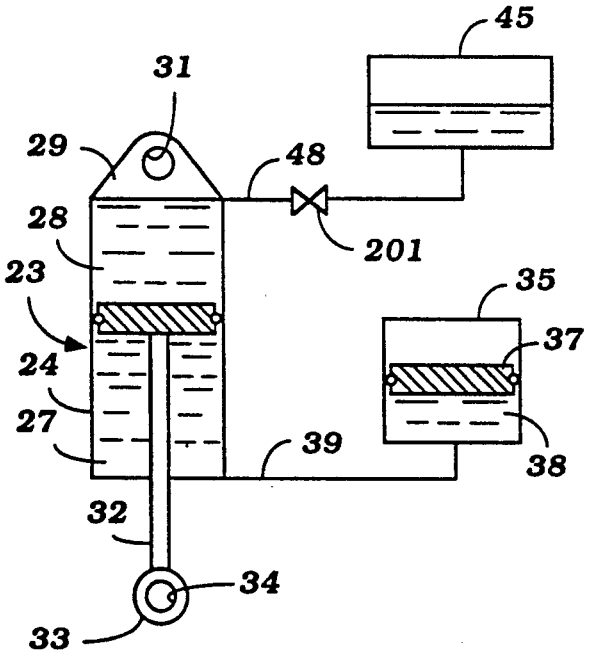
FIG. 5 is a partially schematic cross sectional view, in part similar to FIG. 2 through 4, and shows yet another embodiment of the invention.

FIG. 5 shows another embodiment of the invention which is generally the same as the embodiment of FIG. 2 but wherein the cylinder assembly 23 is inverted. Because of the other similarities of this embodiment to the embodiment of FIG. 2, those components which are the same have been represented by the same reference numerals.

As previously noted, in this embodiment the chambers 27 and 28 are inverted relative to each other and the cylinder assembly 24 has its trunnion portion 29 affixed to the swivel bracket by the pin that goes through the aperture 31 and the piston rod 32 and specifically its eyelet 33 is pivotally connected to the clamping bracket 21 by a pin going through the aperture 34. Because of the inverted relationship, only the accumulator chamber 35 need employ a piston 37.

When an underwater obstacle is struck, the cylinder 24 will move upwardly and compress the fluid in the chamber 27 and cause this fluid to be expelled through the conduit 3 to the accumulator 35. The fluid in the chamber 28 will expand and some of it will vaporize so as to accommodate the increasing volume. This vaporization action will provide sufficient damping to normally prevent popping up but permit popping up to occur when an obstacle is struck with sufficient force. Once the obstacle is past, the device will return as previously described.

In order to permit manual tilt or trim up, a manual release valve 201 is provided in the conduit 48 and which is normally closed. However, when the valve 201 is opened the outboard motor may be easily trimmed up as fluid can flow from the accumulator 45 into the chamber 28 to permit expanding volume without forced vaporization. Of course, when this occurs the fluid will be displaced from the chamber 27 to the accumulator 35 without restriction through the passage 39. Like the previously described embodiments, the pressure in the accumulator 45 can be substantially greater than the pressure in the accumulator chamber 35 so as to provide a lift assist during manual tilt up.

Figure 6:
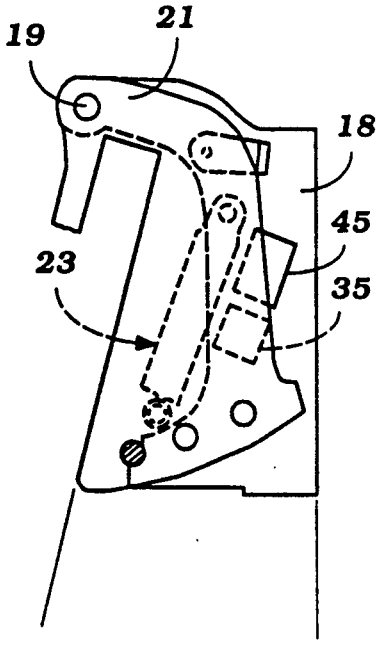
FIG. 6 is a partial side elevational view, in part similar to FIG. 1, and shows how the accumulator chambers of the embodiments of FIGS. 2 through 5 may be positioned with the outboard drive.

FIG. 1 does not show how the accumulator chambers 35 and 45 can be accommodated in the system. FIG. 6 is a partial view showing how these accumulator chambers can be accommodated and in this figure the inverted position of the cylinder 23 as applied in FIG. 5 is employed. It will be noted that the accumulator chambers 35 and 45 can be positioned rearwardly of the cylinder 23 and at least partially between the sides of the clamping bracket 21 so that they will be protected. Of course, using the noninverted embodiments of FIGS. 2 through 4, the accumulator and chambers 35 and 45 will be reversed from their position shown in FIG. 6.

Figure 7:
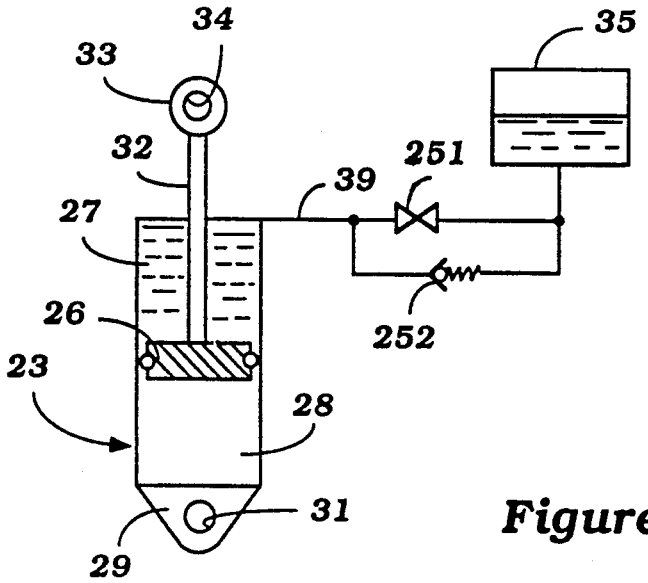
FIG. 7 is a cross sectional view, in part similar to FIGS. 2 through 5, and shows yet another embodiment of the invention.

In all of the embodiments as thus far described there has been provided a hydraulic fluid in both of the chambers 27 and 28. However, this is not necessary and FIG. 7 shows such an embodiment employing an orientation as shown in FIG. 2. Again, due to the similarity of the construction of this embodiment with those previously described components which are the same have been identified by the same reference numerals. In this embodiment, only the chamber 27 is filled with a hydraulic fluid and hence only the accumulator chamber 35 need be employed. The chamber 28 may be filled with a pressurized gas such as either air or nitrogen at an appropriate pressure so as to maintain the outboard motor in a trim adjusted position by the pressure in the chamber 28 and to provide a lift assist for tilt up operation. In the conduit 39 there is provided a manual release valve 251 and an absorber valve 252. The absorber valve 252 permits flow from the chamber 27 to the accumulator 35 but not flow in the reverse direction. As a result of this, if an underwater obstacle is struck the outboard motor may pop up by displacing fluid from the chamber 27 to the accumulator 35 through the open absorber valve 252. The unit may return once the underwater obstacle is cleared slowly by leakage past the valve 252 or, alternatively, the operator may manually return the outboard motor by opening the manual valve 251. Manual tilt up operation is also facilitated by opening the valve 251 wherein the pressure of the gas in the chamber 28 will assist in tilt up.

Figure 8:
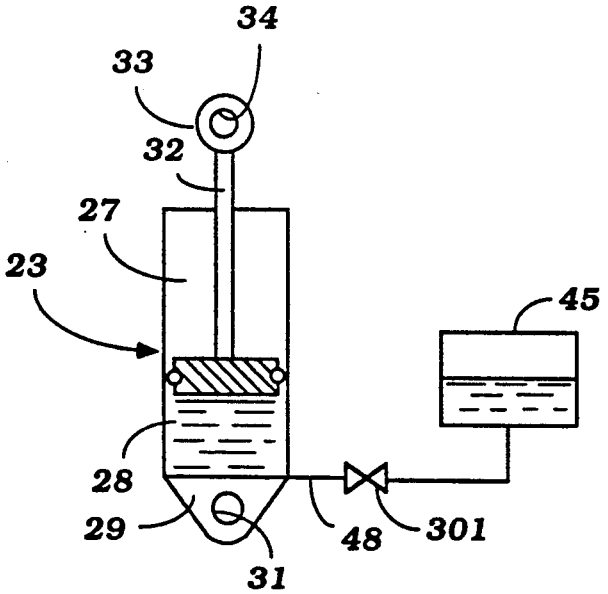
FIG. 8 is a cross sectional view, part similar to FIG. 7, and shows another embodiment of the invention.

FIG. 8 shows another embodiment of the invention which is similar to the embodiment of FIG. 7. In this embodiment, however, the chamber 27 is filled with a pressurized gas and the chamber 28 is filled with a hydraulic fluid. A manual shutoff valve 301 is positioned in the conduit 48 communicating the chamber 28 with its accumulator 45. The accumulator 45 has a gas over the fluid therein that is charged at a greater pressure than the pressure in the chamber 27.

In this embodiment, when an underwater obstacle is struck, the gas in the chamber 27 will be compressed to permit some pop up action and the liquid in the chamber 28 will vaporize. When the underwater obstacle is cleared, the outboard drive may return to its normal position.

To provide tilt up operation with assist, the valve 301 is opened and the outboard drive may be tilted up, as previously described.

It should be readily apparent from the foregoing description that the described embodiments of the invention provide a very simple hydraulic arrangement for controlling a marine outboard drive and wherein it will be insured that the operation cannot be disturbed through the inclusion of air or gas in the system. Also, since the two chambers of the fluid cylinder do not communicate with each other, it is possible to use different fluids in each chamber or, alternatively, fluid in only one chamber. Also, since the two chambers are isolated from each other it is possible to charge the chamber on the tilt up side of the device at a greater pressure than on the other side so as to provide some assist for tilt up operation. Of course, the foregoing description is that of preferred embodiments of the invention and various changes and modifications may be made without the departing from the spirit and scope of the invention, as defined by the appended claims.

I claim:

1. A hydraulic assembly adapted to be positioned between a marine outboard drive and a watercraft for fluid control of the movement of said outboard drive relative to the watercraft, said hydraulic assembly comprising cylinder means adapted to be connected to one of said outboard drive and said watercraft, piston means moveable within said cylinder means and dividing said cylinder means into a pair of opposite chambers, a piston rod affixed at one end to said piston means and extending through one of said chambers and adapted to be affixed at its other end to the other said outboard drive and said watercraft, an accumulator chamber, a conduit communicating said accumulator chamber with only one of said cylinder chambers for flow between said one cylinder means chamber and said accumulator chamber in response to variations in the volume of said one cylinder means chamber as said piston means moves relative to said cylinder means, and manually operable on/off valve means interposed in said conduit comprising a check valve permitting flow through said conduit in only one direction when in the off position.

2. A hydraulic assembly adapted to be positioned between a marine outboard drive and a watercraft for fluid control of the movement of said outboard drive relative to the watercraft, said hydraulic assembly comprising cylinder means adapted to be connected to one of said outboard drive and said watercraft, piston means moveable within said cylinder means and dividing said cylinder means into a pair of opposite chambers, a piston rod affixed at one end to said piston means and extending through one of said chambers and adapted to be affixed at its other end to the other said outboard drive and said watercraft, an accumulator chamber, a conduit communicating said accumulator chamber with only one of said cylinder chambers for flow between said one cylinder means chamber and said accumulator chamber in response to variations in the volume of said one cylinder means chamber as said piston means moves relative to said cylinder means, and manually operable on/off valve means interposed in said conduit, including a check valve and means for manually unseating said check valve for permitting flow in both directions between the one cylinder means chamber and the accumulator.

3. A hydraulic assembly adapted to be positioned between a marine outboard drive and a watercraft for fluid control of the movement of said outboard drive relative to the watercraft, said hydraulic assembly comprising cylinder means adapted to be connected to one of said outboard drive and said watercraft, piston means moveable within said cylinder means and dividing said cylinder means into a pair of opposite chambers, a piston rod affixed at one end to said piston means and extending through one of said chambers and adapted to be affixed at its other end to the other said outboard drive and said watercraft, an accumulator chamber communicating with only one of said cylinder means chambers for flow between said one cylinder means chamber and said accumulator chamber in response to variations in the volume of said one cylinder assembly chamber as said piston means moves relative to said cylinder, a pair of oppositely acting check valve means for permitting flow in either direction between said one cylinder means chamber and said accumulator with one of said check valves opening at a substantially higher pressure than the other of said check valves.

4. A hydraulic assembly as set forth in claim 3 further including manually operable means for unseating at least one of the check valves for permitting manual positioning of the outboard drive.

5. A hydraulic assembly as set forth in claim 3 wherein one of the check valves is positioned in a manually moveable valve member for selectively permitting flow in one direction between the chamber and the accumulator and for blocking the flow in that one direction.

6. A hydraulic assembly as set forth in claim 1 wherein a compressible gas is contained in the other chamber of the cylinder assembly.

7. A hydraulic assembly adapted to be positioned between a marine outboard drive and a watercraft for fluid control of the movement of said outboard drive relative to the watercraft, said hydraulic assembly comprising cylinder means adapted to be connected to one of said outboard drive and said watercraft, piston means moveable within said cylinder means and dividing said cylinder means into a pair of opposite chambers, a piston rod affixed at one end to said piston means and extending through one of said chambers and adapted to be affixed at its other end to the other said outboard drive and said watercraft, an accumulator chamber, a conduit communicating said accumulator chamber with only one of said cylinder chambers for flow between said one cylinder means chamber and said accumulator chamber in response to variations int he volume of said one cylinder means chamber as said piston means moves relative to said cylinder means, manually operable on/-off valve means interposed in said conduit, the other chamber of said cylinder means being filled with a hydraulic fluid and a second accumulator and a second conduit for communicating said other cylinder assembly chamber with said second accumulator.

8. A hydraulic assembly as set forth in claim 7 further including valve means positioned in each of the conduits for controlling the communication between the respective chamber and accumulator.

9. A hydraulic assembly as set forth in claim 8 wherein the valve means comprises a single member for controlling the flow through both of the conduits.

10. A hydraulic assembly as set forth in claim 9 wherein the single member either permits communication of both chambers with their respective accumulators or blocks the communication with both chambers with their respective conduits.

11. A hydraulic assembly as set forth in claim 8 wherein the valve means comprises a pair of check valves each permitting flow from its respective chamber and accumulator and further including manually operable means for unseating each of said check valve means for permitting free flow between said chambers and their respective accumulators.

12. A hydraulic assembly as set forth in claim 11 further including conduit means and a third check valve interposed between one of the chambers and its accumulator for permitting flow from the accumulator to that one chamber.

13. A hydraulic assembly as set forth in claim 8 wherein the valve means comprises a moveable valve member having a first position precluding flow between each of the chambers and the respective accumulator, a second position permitting flow from one of said chambers to its accumulator and for permitting flow from the other accumulator to the other of the chambers and a third position permitting flow from the one accumulator to the one chamber and permitting flow from the other chamber to the other accumulator.

* * * * *